US011535487B2

(12) United States Patent
Herkel

(10) Patent No.: US 11,535,487 B2
(45) Date of Patent: Dec. 27, 2022

(54) ELEVATOR SAFETY SYSTEM

(71) Applicant: Otis Elevator Company, Farmington, CT (US)

(72) Inventor: Peter Herkel, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 478 days.

(21) Appl. No.: 16/690,818

(22) Filed: Nov. 21, 2019

(65) Prior Publication Data

US 2020/0165098 A1 May 28, 2020

(30) Foreign Application Priority Data

Nov. 23, 2018 (EP) ..... 18208158

(51) Int. Cl.

| | |
|---|---|
| ***B66B 1/36*** | (2006.01) |
| ***B66B 1/34*** | (2006.01) |
| ***B66B 5/00*** | (2006.01) |
| ***B66B 5/16*** | (2006.01) |
| ***B66B 7/06*** | (2006.01) |

(52) U.S. Cl.

CPC ..... *B66B 1/36* (2013.01); *B66B 1/3407* (2013.01); *B66B 5/0031* (2013.01); *B66B 5/16* (2013.01); *B66B 7/06* (2013.01)

(58) Field of Classification Search

CPC ..... B66B 5/02; B66B 5/0031; B66B 1/3446; B66B 3/00; B66B 5/0087; B66B 5/00; B66B 5/0018; B66B 5/16; B66B 5/18; B66B 5/0006; B66B 1/36

See application file for complete search history.

(56) References Cited

U.S. PATENT DOCUMENTS

| | | | |
|---|---|---|---|
| 4,690,251 A | 9/1987 | Onoda et al. | |
| 4,898,263 A | 2/1990 | Manske et al. | |
| 5,953,226 A | 9/1999 | Mellish et al. | |

(Continued)

FOREIGN PATENT DOCUMENTS

| | | | | |
|---|---|---|---|---|
| CN | 101039864 A | * | 9/2007 | ..... B66B 5/0031 |
| CN | 201864439 U | | 6/2011 | |

(Continued)

OTHER PUBLICATIONS

European Search Report for application EP 18208158.8, dated Jul. 22, 2019, 8 pages.

(Continued)

*Primary Examiner* — Marlon T Fletcher

(74) *Attorney, Agent, or Firm* — Cantor Colburn LLP

(57) ABSTRACT

An elevator safety system (20) for an elevator system (2) with a self-diagnostic functionality includes at least two safety channels (22*a*, 22*b*), wherein each safety channel (22*a*, 22*b*) is configured for supplying a safety signal (23*a*, 23*b*) in case a safety issue has been detected. The elevator safety system (20) comprises a self-diagnostic evaluator (24), which is configured for receiving any safety signals (23*a*, 23*b*) supplied via the safety channels (22*a*, 22*b*); starting a timer (25) for measuring a predetermined period of time in case a safety signal (23*a*, 23*b*) is supplied on one of the safety channels (22*a*, 22*b*); and stopping any further operation of the elevator system (2) in case the received signal (23*a*, 23*b*) is still supplied after the predetermined period of time has expired.

13 Claims, 2 Drawing Sheets

(56) References Cited

U.S. PATENT DOCUMENTS

Figure 1:
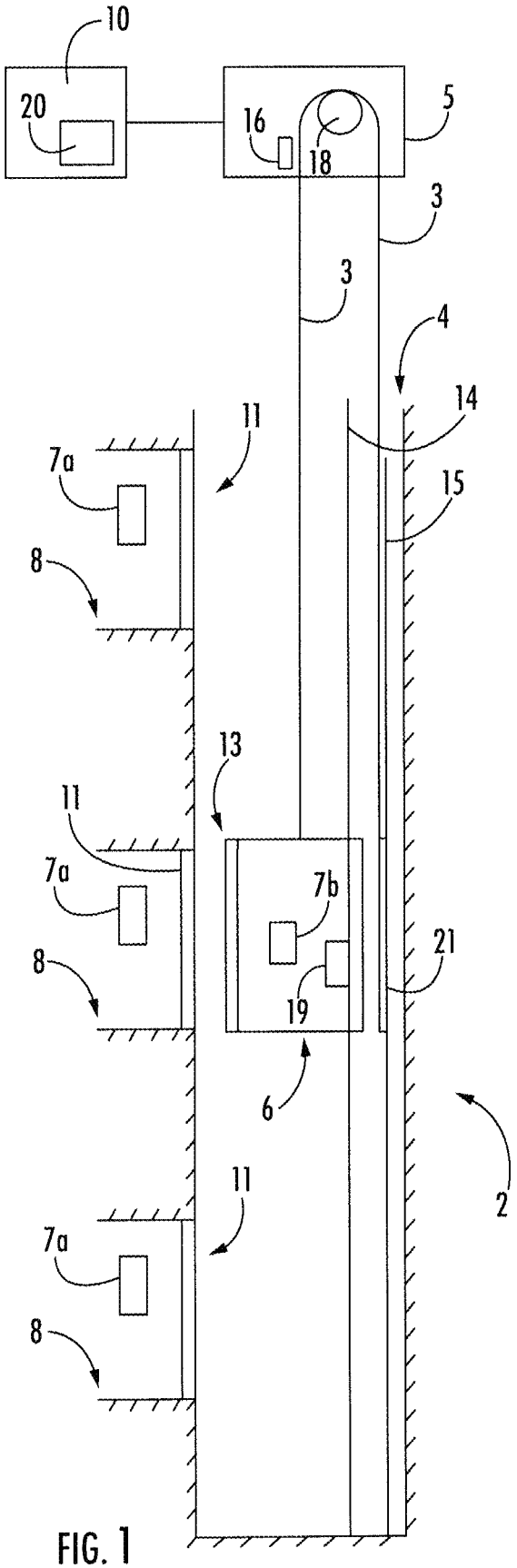

| | | | | |
|---|---|---|---|---|
| 9,327,942 | B2 | 5/2016 | Fukui et al. | |
| 2013/0206515 | A1 | 8/2013 | Quinn | |
| 2019/0389694 | A1 * | 12/2019 | Herkel | B66B 5/005 |

FOREIGN PATENT DOCUMENTS

| | | | | | |
|---|---|---|---|---|---|
| CN | 202625540 | U | | 12/2012 | |
| CN | 103562107 | A | * | 2/2014 | B66B 5/0031 |
| CN | 103832913 | A | | 6/2014 | |
| CN | 203715052 | U | | 7/2014 | |
| CN | 102452595 | B | | 11/2014 | |
| CN | 104860148 | A | * | 8/2015 | B66B 1/40 |
| CN | 107148392 | A | * | 9/2017 | B66B 1/32 |
| CN | 105967006 | B | | 2/2018 | |
| CN | 207346929 | U | | 5/2018 | |
| CN | 108698790 | A | * | 10/2018 | B66B 5/02 |
| EP | 0455919 | A2 | | 11/1991 | |
| EP | 1792864 | A1 | | 6/2007 | |
| EP | 2785626 | B1 | | 10/2015 | |
| EP | 3656718 | A1 | * | 5/2020 | B66B 1/3407 |
| JP | 2001058769 | A | | 3/2001 | |
| JP | 2009073581 | A | | 4/2009 | |
| JP | 4937568 | B2 | | 5/2012 | |
| JP | 2020001923 | A | * | 1/2020 | B66B 1/3492 |
| KR | 100975758 | B1 | | 8/2010 | |
| KR | 102361312 | B1 | * | 2/2018 | |
| WO | WO-2015079976 | A1 | * | 6/2015 | B66B 1/3415 |
| WO | WO-2016037665 | A1 | * | 3/2016 | B66B 1/32 |
| WO | WO-2016062686 | A1 | * | 4/2016 | B66B 1/32 |
| WO | 2017081506 | A1 | | 5/2017 | |
| WO | 2018025408 | A1 | | 2/2018 | |

OTHER PUBLICATIONS

European Examination Report for Application No. 18208158.8; dated Sep. 9, 2022; 5 Pages.

* cited by examiner

ELEVATOR SAFETY SYSTEM

FOREIGN PRIORITY

This application claims priority to European Patent Application No. 18208158.8, filed Nov. 23, 2018, and all the benefits accruing therefrom under 35 U.S.C. § 119, the contents of which in its entirety are herein incorporated by reference.

BACKGROUND

The invention relates to an elevator safety system, in particular to an elevator safety system comprising self-diagnostics functionality. The invention further relates to an elevator system comprising such an elevator safety system, and to a method of operating such an elevator system.

An elevator system typically comprises at least one elevator car moving along a hoistway between a plurality of landings, and an elevator drive, which is configured for driving the elevator car. For securing safe operation, the elevator system may comprise an elevator safety system configured for monitoring the operation of the elevator system and for stopping any further movement of the elevator car in case a safety related issue is detected. The elevator safety system may comprise a self-diagnostic functionality in order to ensure that the elevator safety system operates correctly.

It is desirable to reduce the risk of false alarms triggered by the elevator safety system, in particular triggered by the self-diagnostic functionality of the elevator safety system, in order to prevent unnecessary shutdowns of the elevator system.

BRIEF DESCRIPTION

According to an exemplary embodiment of the invention, an elevator safety system for an elevator system comprises a self-diagnostics functionality including at least two safety channels. Each safety channel is configured for supplying a safety signal in case a safety issue has been detected. The elevator safety system further comprises a self-diagnostic evaluator, which is configured for receiving any safety signals supplied via the safety channels; starting a timer for measuring a predetermined period of time in case a safety signal has been supplied on one of the safety channels; and stopping any further operation of the elevator system in case the safety signal is still supplied after the predetermined period of time has expired.

Exemplary embodiments of the invention further include an elevator system comprising an elevator safety system according to an exemplary embodiment of the invention.

Exemplary embodiments of the invention also include a method of operating an elevator safety system with a self-diagnostics functionality including at least two safety channels, wherein each safety channel is configured for supplying a safety signal in case a safety issue has been detected. The method comprises starting a timer for measuring a predetermined period of time in case a safety signal has been supplied on only one of the safety channels, and stopping any further operation of the elevator system in case the supplied safety signal is still supplied after the predetermined period of time has expired.

Failures of the self-diagnostic functionality may cause temporary safety signals supplied via one of the safety channels of the elevator safety system, which disappear on their own, i.e. without any external measures to be taken.

Such temporary safety signals are related to so called "soft errors". Failures of the self-diagnostic functionality may also cause permanent safety signals related to so called "hard errors". "Hard errors", for example, may result from a physical defect of a component of the elevator system.

An elevator safety system and a method of operation an elevator safety system according to exemplary embodiments of the invention allow reducing the risk of unnecessary shutdowns of an elevator system monitored by the elevator safety system due to "soft errors".

As a result, an elevator safety system and a method of operation an elevator safety system according to exemplary embodiments of the invention enhance the operating time of an elevator system without compromising its safety.

A number of optional features are set out in the following. These features may be realized in particular embodiments, alone or in combination with any of the other features.

Any operation of the elevator system may be stopped in case safety signals are simultaneously supplied on at least two safety channels and/or in case a further safety signal is supplied on another safety channel before the predetermined period of time has expired. In order to maintain the safety of the elevator system, the occurrence of at least two safety signals within the predetermined period of time is interpreted as a severe safety issue resulting in a shutdown of the elevator system.

In order to avoid an unnecessary shutdown of the elevator system in case of "soft errors", the timer may be reset in case the previously supplied safety signal is not present anymore after the predetermined period of time has expired and no further safety signal has been supplied on another safety channel before the predetermined period of time has expired.

The predetermined period of time may be in the range of 1 second to 15 second. The predetermined period of time in particular may be one of 1 second, 5 seconds, 10 seconds, or 15 seconds, respectively. The inventors have found that a predetermined period of time in the range of 1 second to 15 seconds is well suited for distinguishing between "soft errors" which allow continuing the operation of the elevator system, and "hard errors" which require the elevator system to be shut down in order to avoid an unsafe condition of the elevator system.

The self-diagnostic evaluator may be implemented as a cheap and reliable hardware circuit. Additionally or alternatively, the self-diagnostic evaluator may comprise a microprocessor running an appropriate software program. A microprocessor running an appropriate software program allows providing a flexible self-diagnostic evaluator which may be adjusted easily to different elevator systems by amending the software program.

The elevator safety system may comprise a safety chain, in particular an electronic safety chain including electronic safety nodes. The electronic safety nodes may be connected via a field bus system, e.g. a CAN bus, and the electronic safety nodes may communicate using a serial field bus protocol. The elevator safety system provides self-diagnostic functionality, i.e. the safety condition of the individual safety nodes, and of other safety relevant components of the safety system, may be monitored by particularly programmed self-diagnostic safety routines.

Stopping any further operation of the elevator system may include switching off a motor configured for driving the elevator car. Switching off a motor configured for driving the elevator car is the easiest means for bringing an elevator system into a safe state by stopping any further movement of the elevator car.

Stopping any further operation of the elevator system further may include activating a brake and/or a safety device of the elevator system. This enhances the safety of the elevator system by reliably stopping any further movement of the elevator car independently of a motor, if necessary without delay.

DRAWING DESCRIPTION

In the following, exemplary embodiments of the invention are described in more detail with respect to the enclosed figures:

FIG. 1 schematically depicts an elevator system in which a monitoring device according to an exemplary embodiment of the invention may be employed.

Figure 2:
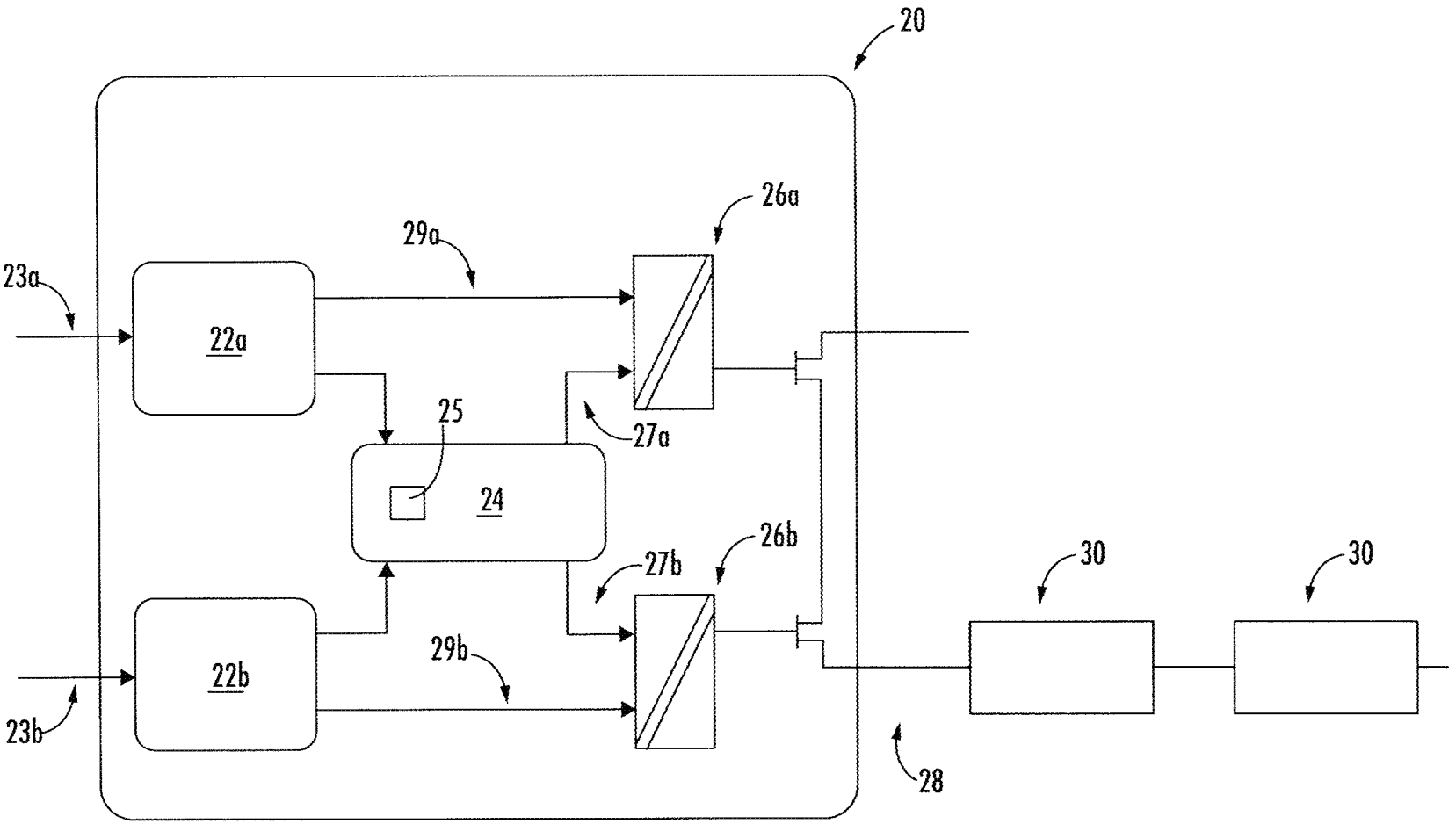

FIG. 2 depicts a schematic view of a monitoring device according to an exemplary embodiment of the invention.

DETAILED DESCRIPTION

FIG. 1 schematically depicts an elevator system 2 with an elevator safety system 20 according to an exemplary embodiment of the invention.

The elevator system 2 includes an elevator car 6 movably arranged within a hoistway 4 extending between a plurality of landings 8. The elevator car 6 in particular is movable along a plurality of car guide members 14, such as guide rails, extending along the vertical direction of the hoistway 4. Only one of said car guide members 14 is depicted in FIG. 1.

Although only one elevator car 6 is depicted in FIG. 1, the skilled person will understand that exemplary embodiments of the invention may include elevator systems 2 having a plurality of elevator cars 6 moving in one or more hoistways 4.

The elevator car 6 is movably suspended by means of a tension member 3. The tension member 3, for example a rope or belt, is connected to an elevator drive 5 comprising a motor 18 and configured for driving the tension member 3 in order to move the elevator car 6 along the height of the hoistway 4 between the plurality of landings 8 located on different floors.

The elevator drive 5 further comprises at least one brake 16, which is configured for braking the tension member 3 in order to brake the movement of the elevator car 6.

Each landing 8 is provided with a landing door 11, and the elevator car 6 is provided with a corresponding elevator car door 13 for allowing passengers to transfer between a landing 8 and the interior of the elevator car 6 when the elevator car 6 is positioned at the respective landing 8.

The exemplary embodiment shown in FIG. 1 uses a 1:1 roping for suspending the elevator car 6. The skilled person, however, easily understands that the type of the roping is not essential for the invention and different kinds of roping, e.g. a 2:1 roping or a 4:1 roping, may be used as well.

The elevator system 2 includes further a counterweight 21 attached to the tension member 3 opposite to the elevator car 6 and moving concurrently and in opposite direction with respect to the elevator car 6 along at least one counterweight guide member 15. The skilled person will understand that the invention may be similarly applied to elevator systems 2 which do not comprise a counterweight 21.

The tension member 3 may be a rope, e.g. a steel core, or a belt. The tension member 3 may be uncoated or may have a coating, e.g. in the form of a polymer jacket. In a particular embodiment, the tension member 3 may be a belt comprising a plurality of polymer coated steel cords (not shown). The elevator system 2 may have a traction drive including a traction sheave for driving the tension member 3.

In an alternative configuration, which is not shown in the figures, the elevator system 2 may be an elevator system 2 without a tension member 3, comprising e.g. a hydraulic drive or a linear drive. The elevator system 2 may have a machine room (not shown) or it may be a machine room-less elevator system 2.

The elevator drive 5 is controlled by an elevator control 10 for moving the elevator car 6 along the hoistway 4 between the different landings 8.

Input to the elevator control 10 may be provided via landing control panels 7*a*, which are provided on each landing 8 close to the landing doors 11, and/or via an elevator car control panel 7*b*, which is provided inside the elevator car 6.

The landing control panels 7*a* and the elevator car control panel 7*b* may be connected to the elevator control 10 by means of electrical wires, which are not depicted in FIG. 1, in particular by an electric bus, or by means of wireless data connections.

The elevator car 6 is equipped with at least one elevator safety device 19. The at least one elevator safety device 19 is configured for engaging with the car guide member 14 for braking the elevator car 6 independently of the elevator drive 5, i.e. independently of the motor 18 and the brake 16 of the elevator drive 5.

Alternatively or additionally, an elevator safety device (not shown) may be provided at the counterweight 21.

The elevator control 10 comprises an elevator safety system 20. The elevator safety system 20 is configured for monitoring the operation of the elevator system 2 and for shutting down the elevator system 2 stopping any further movement of the elevator car 6 in case safety issues, such as safety related malfunctions of any components of the elevator system 2, are detected.

The elevator safety system 20 further comprises a self-diagnostic functionality which allows monitoring the operation of the elevator safety system 20 itself and shutting down the elevator system 2 in case a proper and safe operation of the elevator safety system 20 cannot be ensured.

FIG. 2 depicts a schematic view of an exemplary embodiment of an elevator safety system 20 including self-diagnostic functionality.

The exemplary embodiment shown in FIG. 2 is an implementation comprising two safety channels 22*a*, 22*b*. The skilled person will understand that this is only an exemplary implementation and that more than two safety channels 22*a*, 22*b* may be employed.

The safety channels 22*a*, 22*b* are configured for controlling safety switches 26*a*, 26*b*, which belong to a safety chain (daisy chain) 28 of the elevator system 2. In case a safety signal 23*a*, 23*b* is received on at least one of the safety channels 22*a*, 22*b*, at least one of the safety switches 26*a*, 26*b* is opened due to a corresponding opening signal 29*a*, 29*b* supplied from at least one of the safety channels 22*a*, 22*b* to the corresponding safety switch 26*a*, 26*b*. As a result, the safety chain 28 is interrupted stopping any further movement of the elevator car 6.

The safety chain 28 may be implemented as an electronic safety chain 28 comprising electronic safety nodes 30 connected via a field bus system, e.g. a CAN bus. The electronic safety nodes 30 may communicate using a serial field bus protocol. The elevator safety system 20 provides self-diagnostic functionality, i.e. the safety condition of the individual safety nodes 30, and of other safety relevant components of the safety system 20, may be monitored by particularly programmed self-diagnostic safety routines.

The inventors have found that in a considerable number of cases failures detected by the self-diagnostic functionality and causing a safety signal 23*a*, 23*b* to be supplied are only of temporary duration. These cases are called "soft errors". Only a comparatively smaller number of failures detected by the self-diagnostic functionality are permanent "hard errors", which for example result from physical defects of components of the elevator system.

In a conventional implementation of a self-diagnostic functionality each detection of an unsafe condition leads to safety signals 23*a*, 23*b* supplied on the two parallel safety channels 22*a*, 22*b*. Supply of the safety signal on at least one of the safety channels 22*a*, 22*b* causes an interruption of the safety chain 28. This results in a relatively large number of shutdowns of the elevator system 2 due to "soft errors" found in the self-diagnosing functionality, which would be unnecessary as the problems causing "soft errors" are only of temporary nature.

An elevator safety system 20 according to an exemplary embodiment of the invention therefore comprises a self-diagnostic evaluator 24 connected to all safety channels 22*a*, 22*b*.

In case only one safety signal 23*a*, 23*b* is supplied via the safety channels 22*a*, 22*b*, the self-diagnostic evaluator 24 is configured for overriding the single opening signal 29*a*, 29*b* supplied to one of the safety switches 26*a*, 26*b* by supplying an override signal 27*a*, 27*b* to the respective safety switch 26*a*, 26*b*. The override signal 27*a*, 27*b* overrides the opening signal 29*a*, 29*b* supplied to the respective safety switch 26*a*, 26*b* preventing the safety switch 26*a*, 26*b* from opening. In consequence, the safety chain 28 is not interrupted when only a single safety signal 23*a*, 23*b* is supplied via one of the safety channels 22*a*, 22*b*.

The self-diagnostic evaluator 24 further comprises a timer 25, which is started as soon as a safety signal 23*a*, 23*b* is supplied via one of the safety channels 22*a*, 22*b*.

The timer 25 expires after a predetermined period of time. In case a safety signal 23*a*, 23*b* is still supplied after the timer 25 has expired, the safety signal 23*a*, 23*b* is considered as indicating a "hard error". In consequence, the override signal 27*a*, 27*b* is switched off causing the respective safety switch 26*a*, 26*b* to open interrupting the safety chain 28 and stopping any further movement of the elevator car 6.

In case, however, no safety signal 23*a*, 23*b* is supplied anymore after the timer 25 has expired, the previously supplied safety signal 23*a*, 23*b* is considered as indicating a "soft error" which has vanished on its own. Thus, it is not considered necessary to open the safety chain 28 and stop any further movement of the elevator car 6. Instead, the timer 25 is reset, the override signal 27*a*, 27*b* is switched off, and normal operation of the elevator system 2 resumes. In such a situation, switching of the override signal 27*a*, 27*b* does not cause any of the safety switches 26*a*, 26*b* to open, as no safety signal 23*a*, 23*b* and in consequence no opening signal 29*a*, 29*b* is supplied anymore.

In case, however a second safety signal 23*b*, 23*a* is supplied on a second safety channel 23*b*, 23*a* before the time 25 has expired indicating that at least two safety relevant issues occurred within the predefined amount of time as defined by the timer 25, the overall safety situation of the elevator system 2 is considered as being critical. In consequence, the override signal 27*a*, 27*b* is switched off causing at least one of the safety switches 26*a*, 26*b* to open interrupting the safety chain 28 and stopping any further movement of the elevator car 6.

In other words, operation of the elevator system 2 is stopped immediately in case at least two safety signals 23*a*, 23*b* are supplied on at least two safety channels 22*a*, 22*b* simultaneously or within a predefined period of time.

In case only a single safety signal 23*a*, 23*b* is supplied on one of the safety channels 22*a*, 22*b*, normal operation of the elevator system 2 is provisionally continued for the predefined period of time. If the detected safety signal 23*a*, 23*b* is still supplied after the predefined period of time has expired, operation of the elevator system 2 is stopped.

If the detected safety signal 23*a*, 23*b* is not supplied after the predefined period of time has expired, normal operation of the elevator system 2 is continued.

The predefined period of time may be set to a couple of seconds, in particular to 1 to 15 seconds, more particularly 1 second, 5 seconds, 10 seconds, or 15 seconds, depending on the characteristics of the elevator safety system 20 and its self-diagnostic functionality.

The self-diagnostic evaluator 24 and the timer 25 may be implemented as electronic hardware circuits and/or by at least one microprocessor running an appropriate software program.

An elevator safety system 20 and a method of operation an elevator safety system 20 according to exemplary embodiments of the invention allow reducing the risk of unnecessary shutdowns of an elevator system 2 due to "soft errors", i.e. due to temporary safety signals 23*a*, 23*b* supplied on one of the safety channels 22*a*, 22*b* of the elevator safety system 20, which disappear on their own, i.e. without any external measures to be taken.

At the same time, an elevator safety system 20 and a method of operation an elevator safety system 20 according to exemplary embodiments of the invention do not deteriorate the safety of the elevator system 2 as the elevator system 2 is shut down in case at least two safety signal are supplied within a predefined period of time and/or a single safety signal 23*a*, 23*b* is supplied at least for the predefined amount of time.

Thus, an elevator safety system 20 and a method of operation an elevator safety system 20 according to exemplary embodiments of the invention enhance the operating time of an elevator system 2 without compromising its safety.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention shall not be limited to the particular embodiment disclosed, but that the invention includes all embodiments falling within the scope of the dependent claims.

REFERENCES

2 elevator system
3 tension member
4 hoistway
5 elevator drive
6 elevator car
7*a* landing control panel
7*b* elevator car control panel
8 landing
10 elevator control

11 landing door
12 elevator door panel
13 elevator car door
14 car guide member
15 counterweight guide member
16 brake
18 motor
19 safety device
20 elevator safety system
22*a*, 22*b* safety channels
23*a*, 23*b* safety signals
23*b* second safety signal
24 self-diagnostic evaluator
25 timer
26*a*, 26*b* safety switches
27*a*, 27*b* override signals
28 safety chain
29*a*, 29*b* opening signals
30 safety node

What is claimed is:

1. Elevator safety system (20) for an elevator system (2) with a self-diagnostic functionality including at least two safety channels (22*a*, 22*b*), each safety channel (22*a*, 22*b*) configured for supplying a safety signal (23*a*, 23*b*) in case a safety issue has been detected;

wherein the elevator safety system (20) comprises a self-diagnostic evaluator (24), which is configured for receiving any safety signals (23*a*, 23*b*) supplied via the safety channels (22*a*, 22*b*);

starting a timer (25) for measuring a predetermined period of time in case a safety signal (23*a*, 23*b*) is supplied on one of the safety channels (22*a*, 22*b*); and stopping any further operation of the elevator system (2) in case the safety signal (23*a*, 23*b*) is still supplied after the predetermined period of time has expired;

wherein the self-diagnostic evaluator (24) is configured for stopping any further operation of the elevator system (2) in case safety signals (23*a*, 23*b*) are simultaneously supplied on at least two safety channels (22*a*, 22*b*) and/or in case a further safety signal (23*b*, 23*a*) is supplied on another safety channel (22*b*, 22*a*) before the predetermined period of time has expired.

2. Elevator safety system (20) according to claim 1, wherein the predetermined period of time is in the range of 1 second to 15 seconds, wherein the predetermined period of time in particular is one of 1 second, 5 seconds, 10 seconds, or 15 seconds.

3. Elevator safety system (20) according to claim 1, wherein the self-diagnostic evaluator (24) is implemented as a hardware circuit, and/or wherein the self-diagnostic evaluator (24) comprises a microprocessor running an appropriate software program.

4. Elevator safety system (20) according to claim 1, further comprising a safety chain (28), the safety chain (28) in particular being implemented as an electronic safety chain (28) comprising at least one electronic safety node (30).

5. Elevator system (2) comprising: at least one elevator car (6) configured for traveling along a hoistway (4) between a plurality of landings (8); and an elevator safety system (20) according to claim 1.

6. Elevator system (2) according to claim 5, comprising a motor (18) configured for driving the elevator car (6), wherein stopping any further operation of the elevator system (2) includes switching off the motor (18).

7. Elevator system (2) according to claim 5, comprising a brake (16) and/or a safety device (19) configured for stopping and preventing any further movement of the elevator car (6), wherein stopping any further operation of the elevator system (2) includes activating the brake (16) and/or the safety device (19).

8. Elevator safety system (20) for an elevator system (2) with a self-diagnostic functionality including at least two safety channels (22*a*, 22*b*), each safety channel (22*a*, 22*b*) configured for supplying a safety signal (23*a*, 23*b*) in case a safety issue has been detected;

wherein the elevator safety system (20) comprises a self-diagnostic evaluator (24), which is configured for receiving any safety signals (23*a*, 23*b*) supplied via the safety channels (22*a*, 22*b*);

starting a timer (25) for measuring a predetermined period of time in case a safety signal (23*a*, 23*b*) is supplied on one of the safety channels (22*a*, 22*b*); and stopping any further operation of the elevator system (2) in case the safety signal (23*a*, 23*b*) is still supplied after the predetermined period of time has expired;

wherein the self-diagnostic evaluator (24) is configured for resetting the timer (25) in case the received safety signal (23*a*, 23*b*) is not supplied anymore after the predetermined period of time has expired and no further safety signal (23*b*, 23*a*) has been supplied on another safety channel (22*b*, 22*a*) before the predetermined period of time has expired.

9. Method of operating an elevator safety system (20) system with a self-diagnostic functionality including at least two safety channels (22*a*, 22*b*), each safety channel (22*a*, 22*b*) configured for supplying a safety signal (23*a*, 23*b*) in case a safety issue has been detected;

wherein the method comprises:

starting a timer (25) for measuring a predetermined period of time in case a safety signal (23*a*, 23*b*) is supplied on only one of the safety channels (22*a*, 22*b*);

stopping any further operation of the elevator system (2) in case the supplied safety signal (23*a*, 23*b*) is still supplied after the predetermined period of time has expired;

wherein the method further includes stopping any further operation of the elevator system (2) in case safety signals (23*a*, 23*b*) are simultaneously supplied on at least two safety channels (22*a*, 22*b*) and/or a further safety signal (23*b*, 23*a*) is supplied on another safety channel (22*b*, 22*a*) before the predetermined period of time has expired.

10. Method according to claim 9, wherein the predetermined period of time is in the range of 1 second to 15 seconds, wherein the predetermined period of time in particular is one of 1 second, 5 seconds, 10 seconds, or 15 seconds.

11. Method according to claim 9, wherein stopping any further operation of the elevator system (2) includes switching off any motor (18) configured for driving the elevator car (6).

12. Method according to claim 9, wherein stopping any further operation of the elevator system (2) includes activating a brake (16) and/or a safety device (19) configured for stopping and preventing any further movement of the elevator car (6).

13. Method of operating an elevator safety system (20) system with a self-diagnostic functionality including at least two safety channels (22*a*, 22*b*), each safety channel (22*a*, 22*b*) configured for supplying a safety signal (23*a*, 23*b*) in case a safety issue has been detected;

wherein the method comprises:

starting a timer (25) for measuring a predetermined period of time in case a safety signal (23*a*, 23*b*) is supplied on only one of the safety channels (22*a*, 22*b*);

stopping any further operation of the elevator system (2) in case the supplied safety signal (23*a*, 23*b*) is still supplied after the predetermined period of time has expired;

wherein the method further includes resetting the timer (25) in case the safety signal (23*a*, 23*b*) is not supplied after the predetermined period of time has expired and no further safety signal (23*b*, 23*a*) has been supplied on another safety channel (22*b*, 22*a*) before the predetermined period of time has expired.

* * * * *